US005490918A

United States Patent [19]

Meek

[11] Patent Number: 5,490,918

[45] Date of Patent: Feb. 13, 1996

[54] SLUDGE DISPOSAL PROCESS

[75] Inventor: Thomas D. Meek, Sedro-wooly, Wash.

[73] Assignee: Texaco Inc., White Plains, N.Y.

[21] Appl. No.: 343,211

[22] Filed: Nov. 22, 1994

Related U.S. Application Data

[63] Continuation of Ser. No. 48,693, Apr. 16, 1993, abandoned, which is a continuation of Ser. No. 628,071, Dec. 17, 1990, abandoned, which is a continuation of Ser. No. 301,577, Jan. 25, 1989, abandoned.

[51] Int. Cl.[6] ..... C10G 9/14

[52] U.S. Cl. ..... 208/131; 208/50

[58] Field of Search ..... 208/131

[56] References Cited

U.S. PATENT DOCUMENTS

| | | | |
|---|---|---|---|
| 3,971,564 | 11/1975 | Meyers | 208/131 |
| 4,666,585 | 5/1987 | Figgins | 208/131 |
| 4,874,505 | 10/1989 | Bartilucci | 208/131 |

*Primary Examiner*—Helane Myers

[57] ABSTRACT

A process for disposing of industrial waste or petroleum sludge in a delayed coking process wherein said waste or sludge is introduced into the hot coke in combination with steam in the steam cooling phase of the delayed coking process is provided.

5 Claims, No Drawings

SLUDGE DISPOSAL PROCESS

This is a continuation of application Ser. No. 08/048,693 filed Apr. 16, 1993, now abandoned, which is a continuation of Ser. No. 07/628,071 filed Dec. 17, 1990, now abandoned, which is a continuation of Ser. No. 07/301,577 filed Jan. 25, 1989, now abandoned.

BACKGROUND OF THE INVENTION

1. Field of the Invenrion

This invention is concerned with a method for disposing of industrial wastes or, more specifically, petroleum sludge in a delayed coking process for heavy petroleum fractions.

2. The Prior Art

Delayed coking has been practiced in the petroleum industry for many years for the purpose of extracting a maximum amount of liquid products from reduced petroleum crudes or heavy residua.

In the delayed coking process, a reduced crude oil or residual petroleum fraction is heated to coking temperatures and is fed into a large holding vessel or coke drum under conditions which promote thermal cracking and polymerization to produce light hydrocarbon distillate fractions which pass overhead to a fractionator, and solid petroleum coke which remains in and eventually fills the drum.

In the usual practice of the delayed coking process, a residual oil from a fractionator wherein the lighter products have been separated by distillation, the resulting residual oil is pumped through a furnace where it is heated to the required coking temperature and then discharged into the bottom of a coke drum. The heated residual oil enters the coke drum at a temperature from about 875° to 950° F. The contents of the coke drum are held at these thermal cracking temperatures during the period it is being charged.

After a predetermined filling time, the contents in the coke drum are cooled down in a series of distinct steps. First stage cooling is effected by passing steam into the coke drum for a sufficient period of time to cool the contents of the drum down to about 675° to 725° F. This steam cooling period also serves as a means in which any remaining volatile hydrocarbons are steam distilled or "stripped" from the coke bed and which are first recovered from the overhead of the coke drum by the coker fractionator and then later by a blowdown or vapor recovery system. Cooling in a second stage begins with the introduction of water into the coke drum. In this second stage of cooling, the water is converted to steam which serves to further promote the removal of additional vaporizable hydrocarbons produced in the coke drum. In the final cooling stage, liquid water cools the coke to a temperature usually less than 212° F. which will permit it's mechanical removal from the coke drum making the unit available for a fresh charge of residual oil for coking.

An important aspect of the delayed coking process is the quality of the coke that is produced. The coke is a marketable product. High quality coke meeting certain specifications as to its volatile content can be marketed at a premium price as green coke suitable for calcining to anode quality carbon for use in the electrolytic processing industries. On the other hand, coke that does not meet these specifications is only useful as fuel coke and has a lower economic value.

With the advent of strict environmental laws with respect to the disposal of industrial wastes, such as petroleum sludge, the delayed coking process which produces a large body of high temperature coke maintained under thermal cracking conditions has been proposed for decomposing or destructively reducing treatable industrial wastes thereby effectively disposing of them.

U.S. Pat. No. 4,666,585 discloses a method for the disposal of petroleum sludge wherein petroleum sludge is added to the hot liquid hydrocarbon feedstock or charge as it is being fed into the coke drum at the start of the coking process.

U.S. Pat. No. 3,917,564 discloses a method for the disposal of industrial and sanitary wastes wherein liquid sludge containing dispersed combustible matter and fine discrete solid particles is added to liquid water in an intermediate cooling step in the coke cooling cycle.

The foregoing methods for disposing of industrial wastes or petroleum sludge may have significant limitations with respect to the amount of waste material that can be disposed of in a single delayed coking cycle when in anode quality green coke production, as with U.S. Pat. No. 3,917,564, and by possible limiting delayed coking unit charge rate, as with U.S. Pat. No. 4,666,585.

SUMMARY OF THE INVENTION

This invention provides a method for disposing of industrial wastes or petroleum sludge in a delayed coking process characterized in that the industrial waste or petroleum sludge is added to the live steam which is employed in the initial steam cooling step in the delayed coking cycle.

DESCRIPTION OF THE PREFERRED EMBODIMENT

Broadly stated, this invention is a process for producing a premium petroleum coke while at the same time effecting the disposal of a treatable industrial waste or a petroleum sludge. The particular novel feature in this delayed coking process is the introduction of the treatable waste or petroleum sludge with steam during the steam cooling phase of the delayed coking process. In a more specific embodiment, the waste or sludge is mixed with live steam during only a portion of the steam cooling step. Usually this is done during the beginning of the steam cooling phase after the coke drum overhead vapors have been diverted away from the delayed coker fractionators and into the coker blowdown or vapor recovery system. Thereafter, the injection of waste or sludge is discontinued and cooling continued with steam alone. The steaming rate may be at the same or at a higher rate, and is continued until the coke is cooled to about 675° F. to 725° F.

A suitable charge stock for coking operations is well known in the art. The principle charge stocks are high boiling virgin or cracked petroleum residua such as virgin reduced crude; bottoms from the vacuum distillation of reduced crudes otherwise known as vacuum reduced residua, various extracts, thermal tar and other heavy residua.

In the delayed coking process, the charge stock is pumped at an elevated pressure into a furnace where it is preheated to a temperature from about 875° to about 950° F. The heated charge is then passed into a vertical coking drum through an inlet at the base. An elevated pressure is generally maintained in the coking vessel ranging from about 20 to about 80 psi. Since the drum is insulated to retain heat, the charge is maintained at substantially the charge temperature of about 800° to 950° F. while thermal cracking takes place in the coking drum.

After a predetermined coking period, which may be from about 12 to 24 hours long, the contents in the coke drum must be cooled to facilitate its removal from the coke drum making the unit available for another coking cycle. According to conventional practice cooling is conducted in distinct stages. First, live steam is passed into the coke drum for a period of time sufficient to reduce the temperature of the coke in the coke drum to about 675° to 725° F. When the temperature of the coke has been reduced to the indicated level, the first cooling step in the coke cooling cycle has been completed.

Second stage cooling in the coke cooling cycle starts with the addition of water into the coking unit. This water is converted to steam and this steam serves to promote the removal of any volatile hydrocarbons present in the delayed coker. As the coke in the coker cools further, the water being injected remains in its liquid phase. This is the third phase in the cooling cycle of the delayed coking process. When the contents have been cooled to a safe and convenient working temperature, the solid coke in the coker unit may be removed by any of a variety of physical methods to prepare the unit for another delayed coking cycle. The coke product depending on its quality is marketed either as anode grade coke or fuel coke.

It has now been discovered that industrial wastes, such as petroleum sludge, can be treated and destructively reduced and disposed of when mixed with steam in the steam cooling step of the delayed coke cooling cycle. More specifically, in the first phase cooling of the coke while the coke is substantially at its initial thermal cracking temperature of about 800°–900° F. and steam is the sole agent being employed as the first stage cooling medium, it was surprisingly discovered that the waste or petroleum sludge could be mixed with the steam and the mixture introduced into the coker during this steam cooling phase thus exposing not only the petroleum sludge to steam distillation or stripping just prior to entering and while inside the coke drum. Not only was this method very effective in thermally degrading and stripping petroleum sludge, but it was discovered that a large amount of petroleum sludge could be so disposed of without adversely effecting the quality of the anode grade green coke produced using this method.

The following example illustrates the practice of this invention.

EXAMPLE

In a typical comparison run, a vacuum residual charge known to produce anode quality coke was pumped into a fixed heater wherein it was heated up to about 920° F. The heated charge was then passed into a large delayed coker vessel which was filled over a period of about 19 hours. At the end of the 19 hr. filling period, the delayed coking heater effluent was diverted into another warmed up coke drum.

Cooling was commenced by first introducing 250 lb. steam into the off-stream coke drum at the rate of about 6,460 pounds per hour while the coke drum overhead vapors continued to the coker fractionator. This was continued for about 45 minutes, after which the drum overhead vapors were diverted to the blowdown and vapor recovery system. Steam injection was then increased to about 10,400 pounds per hour for one hour and then to about 16,150 pounds per hour for about one half hour until the temperature of the coke in the drum dropped to about 700° F. The steam injection was discontinued and water was then introduced into the coker over a five and one half hour period with collection of the vapor products overhead. Water was injected into the coke in the coke drum until the coke had reached a low enough temperature to permit its removal from a coke drum.

The coke product from this run was characterized by containing about 9.6 weight percent volatile combustible material. The quality of coke having less than 10% volatile combustible material passes the specification for anode grade petroleum coke, the best grade of green or unclaimed petroleum coke.

A similar run was conducted using the same vacuum residual charge heated to about 920° F. in a fixed heater and passed into a coke drum over a similar period of time. When the drum was filled with the heated vacuum residual charge, the coker feed was interrupted and the cooling cycle started In this case, after the same initial steaming with 6,460 pounds per hour for the same time period and after the coke drum overhead vapors were routed to the blowdown and vapor recovery system, petroleum sludge and steam at a rate of about 10,400 pounds per hour were then injected together into the coke drum.

The injection of the mixture of petroleum sludge and 10,400 pounds per hour steam was continued for about one hour. Sludge injection was continued with a steam rate of about 16,150 pounds per hour for a period of about one half hour until the coke temperature had been cooled to about 700° F.

Water alone was then injected into coke drum which immediately turned to steam in this phase of cooling. Water injection was continued until the water remained liquid in the final cooling stage. Total water injection time was again five and one half hours.

On analysis, the coke produced in this process had a volatile combustible content of approximately 9.6 weight percent. This coke passed the specification for anode grade petroleum coke.

The significance of this run is that the sludge injection with steam continued for approximately one and one half hours duration. As a result, a substantial amount of petroleum sludge was treated and disposed of when it was injected with steam in the delayed coker process without any diminishment in the quality of the anode grade petroleum coke that was produced. This represents a substantial improvement over earlier method for dispersing of petroleum sludge in a delayed coker process.

In past practices, such as U.S. Pat. No. 3,917,564 industrial and sanitary wastes are disposed of by injecting during the water cooling cycle in which the coke temperature may only be 625° to 725° F. initially and then rapidly falls off to 425° to 525° F. after the first hour of water cooling. My method of injecting petroleum sludge during the steam cooling cycle has the advantage of exposing said petroleum sludges to temperatures in the range of 700° to 800° F. for a period of one and one half to possibly two hours. This facilitates and helps ensure that complete thermal decomposition of said petroleum sludges occurs, which is of prime importance in anode grade coke production. In addition, due to the higher temperature profile of the coke during steam cooling versus water cooling, more sludge can be disposed of while still maintaining anode coke production specifications.

What is claimed:

1. A process for deodorizing, sterilizing and disposing of odor producing petroleum sludge or industrial waste and to produce a sanitized and deodorized petroleum coke, said process consisting essentially of disposing of and sanitizing and deodorizing said odor producing petroleum sludge or industrial waste by mixing said sludge or waste with steam and utilizing said mixture during a portion of a steam cooling step of a three stage cooling procedure of hot coke in a delayed petroleum coke process said three cooling stages comprising a) the sludge or waste and steam mixture cooling stage, b) an intermediate water to steam cooling stage, and c) a liquid water cooling stage wherein the hot coke is at a temperature above 725° F.; wherein the mixture of steam and sludge or waste is injected during the said steam cooling step after coke drum vapors are diverted to a delayed coke blowdown/vapor recovery system thus exposing the mixture of steam and petroleum sludge or waste to steam distillation or "stripping" just prior to entering and while inside the coke drum and to thermal decomposition once deposited on the hot coke.

2. A process according to claim 1 in which the coke produced in said process is anode grade petroleum coke which is sterile and odor-free.

3. A process according to claim 1 in which coker feedstock is introduced into a delayed coker at a temperature from about 825° to 950° F. and said steam cooling step reduces the temperature of said coker to a range from about 675° to 725° F.

4. A process according to claim 1 in which the mixture of petroleum sludge and steam are introduced at a rate of about 10,000 to 16,000 pounds per hour.

5. A process according to claim 1, wherein injection of waste or sludge and steam is discontinued and cooling is continued with steam alone.

* * * * *